United States Patent [19]

Posey

[11] 4,454,204

[45] Jun. 12, 1984

[54] NOVELTY NOISEMAKER AND BANK

[76] Inventor: Mervin E. Posey, 3203 Walters La., #204, Forestville, Md. 20028

[21] Appl. No.: 475,627

[22] Filed: Mar. 15, 1983

[51] Int. Cl.[3] ..... A63H 5/00

[52] U.S. Cl. ..... 428/542.4; 446/8; 446/419; D11/157; D21/65; D99/37; 428/11

[58] Field of Search ..... D21/65; D11/131, 132, D11/133, 157; D99/37; 46/2, 193; 229/8.5; 40/538, 540; 428/9, 11, 542.2, 542.4; 232/4 R, 4 D

[56] References Cited

U.S. PATENT DOCUMENTS

| | | | |
|---|---|---|---|
| D. 151,599 | 11/1948 | Colm | D21/65 |
| D. 151,600 | 11/1948 | Colm | D21/65 |
| D. 155,467 | 10/1949 | Weill | D99/37 |
| D. 158,699 | 5/1950 | Wasilevich | D11/131 X |
| D. 161,318 | 12/1950 | Cooper | 46/2 X |
| 1,124,896 | 1/1915 | Hartman | 232/4 R |
| 2,779,128 | 1/1957 | West | 232/4 R X |
| 3,231,993 | 2/1966 | Levy | D11/131 X |

FOREIGN PATENT DOCUMENTS

| | | | |
|---|---|---|---|
| 578539 | 7/1946 | United Kingdom | 46/193 |

*Primary Examiner*—Henry F. Epstein
*Attorney, Agent, or Firm*—D. Paul Weaver

[57] ABSTRACT

A combined bank for coins and noisemaker forms an attractive and durable hand-held device for displaying the name of a favorite athletic team or the like at indoor and outdoor events. Provision was made for advertising indicia on the device. The body portion can be shaped to resemble a football or other game ball.

3 Claims, 4 Drawing Figures

FIG.1
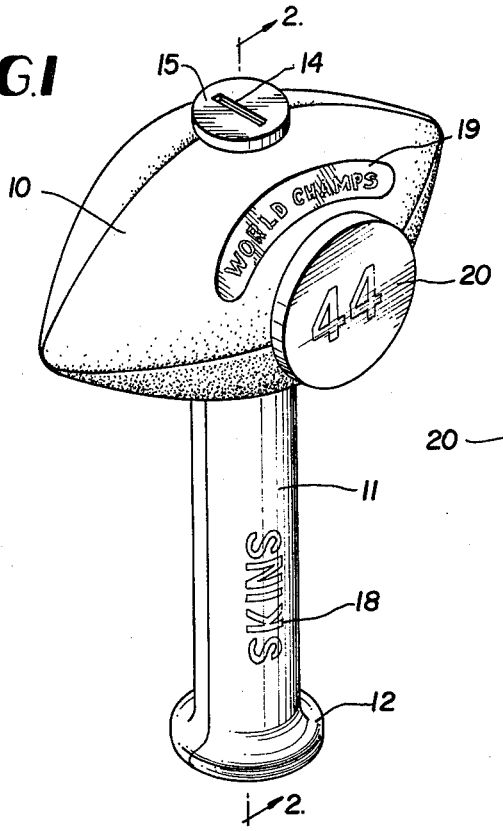
FIG.2
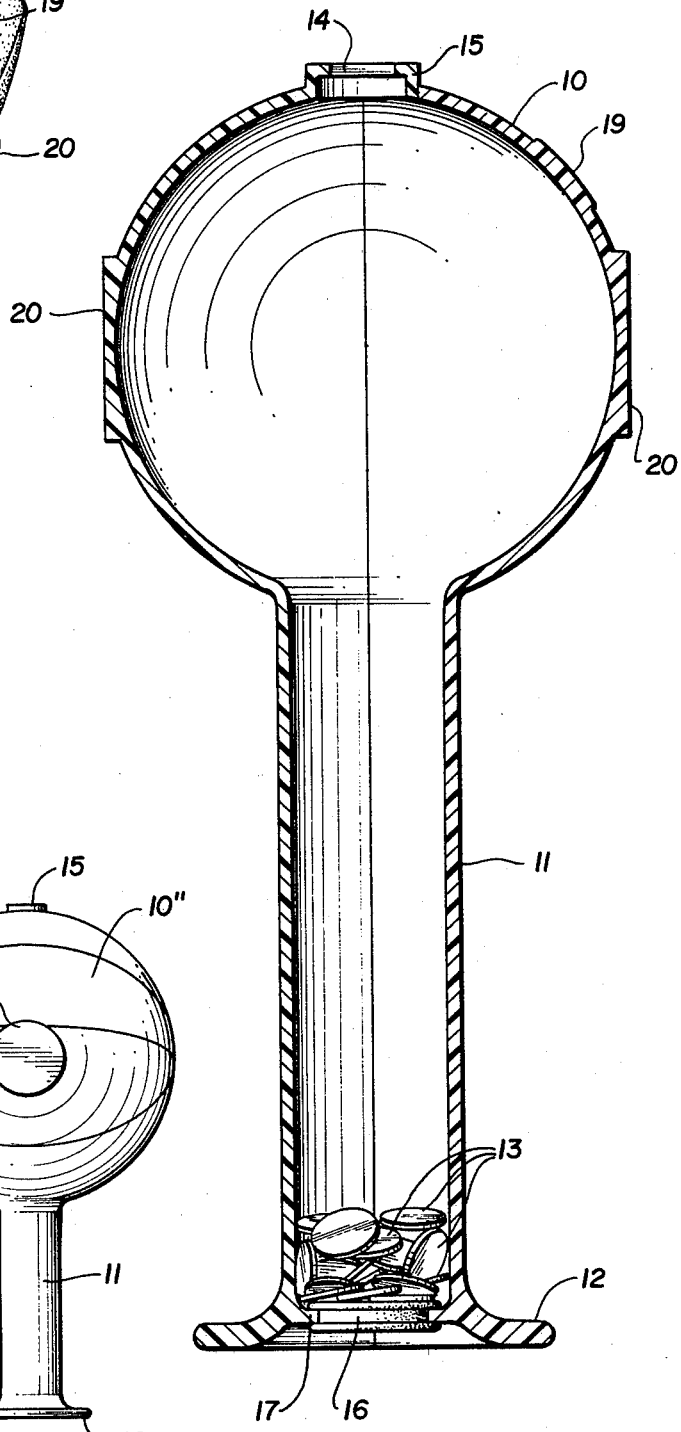
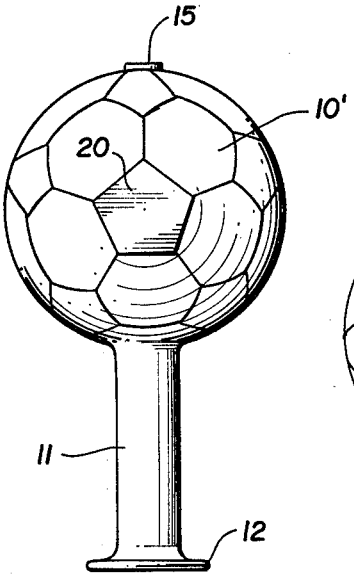
FIG.3
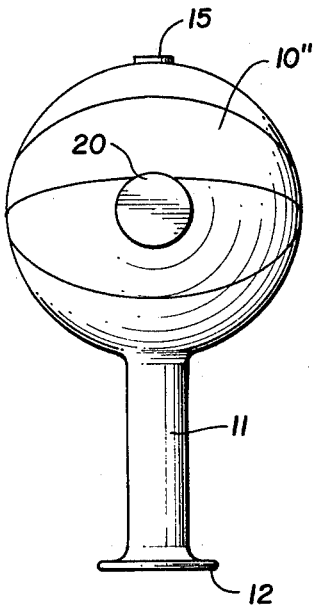
FIG.4

NOVELTY NOISEMAKER AND BANK

BACKGROUND OF THE INVENTION

Traditionally, cloth pennants and paper signs are displayed by fans at athletic contests bearing the names of their favorite teams. Such pennants and signs possess little utility after completion of the game or contest and are frequently discarded after a single use. This is an expensive practice and wasteful.

The object of this invention is to provide a device for cheering on one's own team or other competitive entity, and also possessing long term utility for other purposes, the device being inexpensive to manufacture, convenient to use, light weight, and durable.

More particularly, it is an object of the invention to provide a hand-held noisemaker in the nature of a rattle and simultaneously forming a means for displaying visually a favorite team at an athletic contest, and additionally possessing the capability of serving as a bank for coins. The device is unitary in nature and can be formed of inexpensive material such as molded plastics material. It includes a convenient handle, topped by an enlarged hollow body portion which can be shaped to resemble a football or the like. The body portion is provided with a coin slot and surfaces for the display of a team name and/or advertising material. Preferrably, the end of the handle has a coin removal plug.

Other features and advantages of the invention will be apparent to those skilled in the art during the course of the following description.

BRIEF DESCRIPTION OF THE DRAWINGS

FIG. 1 is a perspective view of a novelty noisemaker and coin bank according to the present invention.

FIG. 2 is an enlarged central vertical section taken on line 2—2, FIG. 1.

FIG. 3 is a side elevation of the invention according to a modification.

FIG. 4 is a side elevation of the invention according to another modification.

DETAILED DESCRIPTION

Referring to the drawings in detail, wherein like numerals designate like parts, a novelty noisemaker and coin bank adapted to be molded from plastics comprises a bulbous hollow relatively thin-walled body portion 10 possessing the shape of a football or other ball used in athletic contests. Joined integrally with the body or head-portion 10 centrally and extending therefrom in one direction is a hollow cylindrical handle 11 having an end flange 12 for security. The interior chambers of the handle 11 and body portion 10 communicate to form one relatively large chamber for coins 13 and/or noisemaking ball elements, not shown, if desired.

A coin entrance slot 14 is formed through a raised boss 15 which is coaxial with the handle 11 and formed on the side of the body portion 11 remote from the handle. A removable closure plug 16 is provided on an end wall 17 of the handle 11 to permit removal of coins periodically when they have accumulated inside the device. Prior to their removal the coins 13 can serve as the noisemaking elements of the device which is in the nature of a rattle. The size of the device can vary and is not critical. However, a practical embodiment would measure about 18 inches lengthwise from the flange 12 to the surface of boss 15, the handle 11 measuring about 2 to 2 and ½ inches in diameter, and the ball body portion 10 being sized proportionally.

The name of a favorite team indicated at 18 can be molded or otherwise applied to the handle 11 on one or both sides thereof. Other surfaces 19 and 20 are similarly provided on the body portion 10 to display a championship year date and/or suitable advertising indicia.

At an athletic contest such as a football game the novelty device is used in lieu of a pennant to display the name of a favorite team. It is also used to make noise for cheering the team on and has the added capability of serving as a coin bank. The device is reusable and is of a relatively permanent nature for the sake of economy. It is convenient to hold and manipulate, durable and inexpensive.

FIG. 3 shows the device as described in connection with FIGS. 1 and 2 except that the body portion 10' is in the form of a soccer ball instead of a football. Similarly, FIG. 4 depicts the body portion 10'' in the form of a basketball. Except for this change, the device and its use remains exactly the same as in the first embodiment.

It is to be understood that the form of the invention, herewith shown and described is to be taken as a preferred example of the same, and various changes in the shape, size, and arrangement of parts may be resorted to, without departing from the spirit of the invention or the scope of the sub-joined claims.

I claim:

1. A combined coin bank, noisemaker and display device comprising a hollow bulbous head portion having the shape and appearance of an athletic team ball and having a plurality of exterior indicia bearing surfaces upon which the name of an athletic team and other identifying indicia pertaining to such team may be placed, the bulbous head portion having a coin deposit slot substantially in its forward face, a hollow elongated handle integrally joined to the head portion and extending from the side thereof which is rearward from and opposite to the coin slot, the interiors of the handle and head portion being in open communication to form a common chamber for coins and also forming a noisemaker chamber to amplify sound generated by the rattling of coins within said chamber, a removable closure element for the end of the hollow handle distal from the head portion to enable periodic removal of coins from said chamber, an enlarged flange on said distal handle end to enable secure handling of the device when used as a noisemaker and to stabilize the device when it is placed on a support surface, and the entire device being molded as a unit from plastics material, except for the removable closure plug.

2. A combined coin bank, noisemaker and display device as defined in claim 1, and said head portion having the shape of a football.

3. A combined coin bank, noisemaker and display device as defined in claim 1, and said head portion being substantially spherical.

* * * * *